United States Patent [19]

Steiner et al.

[11] 4,173,067

[45] Nov. 6, 1979

[54] APPLICATOR APPARATUS FOR USE WITH ROTARY CONNECTOR

[75] Inventors: Charles D. Steiner; Matthew M. Sucheski, both of Harrisburg, Pa.

[73] Assignee: AMP Incorporated, Harrisburg, Pa.

[21] Appl. No.: 850,171

[22] Filed: Nov. 10, 1977

[51] Int. Cl.[2] ..... H01R 43/04

[52] U.S. Cl. ..... 29/749; 29/751; 29/758; 29/759; 29/816

[58] Field of Search ..... 29/749, 750, 751, 753, 29/758, 759, 816

[56] References Cited

U.S. PATENT DOCUMENTS 3,707,867 1/1973 Mayala ..... 29/751 X 3,866,297 2/1975 Aldridge et al. ..... 29/749 X

*Primary Examiner*—Carl E. Hall

*Attorney, Agent, or Firm*—Anthony S. Volpe; Frederick W. Raring

[57] ABSTRACT

A hand tool for use with a rotary splicing connector which can be used to terminate a plurality of insulated wires is disclosed. The connector consists of two mutually rotatable housing components. Insulated wires can be spliced during rotation of the two housing components. The hand tool includes a lever to generate the required torque on the connector members. The tool includes a magazine used to sequentially feed a plurality of connectors in tandem orientation.

8 Claims, 11 Drawing Figures

APPLICATOR APPARATUS FOR USE WITH ROTARY CONNECTOR

BACKGROUND OF THE INVENTION

1. Field of the Invention

This invention relates to apparatus for assemblying and terminating a plurality of wires in an electrical device which includes mutually rotatable component parts. This invention also relates to apparatus having a magazine for feeding a plurality of separate components into operative position in a hand manipulable tool. This invention also relates to a hand tool which sequentially positions connectors to accept a plurality of wires to be spliced and upon actuation imparts rotary movement to the connectors to splice the plurality of wires.

2. Description of the Prior Art

The hand applicator tool disclosed in this application is intended for use with a multi-part rotary electrical connector of the type fully disclosed herein and also disclosed in copending application Ser. No. 850,584. This connector utilizes a slotted plate contact terminal to pierce the insulation and establish contact with the underlying conductive core to form a splice between two or more conductors.

A number of electrical connectors utilizing a slotted plate terminal are known. The majority of these electrical connectors consist of a two-piece member in which the separate components are arranged in telescoping or piston-like relationship. Contact with the wires is established by forcing one component part relatively into a second component part. These piston-type connectors can be applied using any of a number of plier-like tools. More elaborate tools which terminate one connector and feed connectors into a terminating position are also known. U.S. Pat. No. 3,707,867 is one example of a tool having a wire feeding magazine, which sequentially terminates connectors located in tandem configuration.

SUMMARY OF THE INVENTION

Hand apparatus for splicing a plurality of wires in a two-part rotary electrical connector is disclosed and claimed. This apparatus has a generally open ended connector terminating station into which individual connectors, located in tandem orientation, are sequentially fed. Means are provided to position the connectors in the connector terminating station in proper alignment. As the tool is actuated, suitable levers apply relative torque between the two mutually rotatable connector components. Electrical contact between a plurality of appropriately positioned wires is established during rotation of the two connector housing components. The terminated connector is then dispensed from one end of the connector terminating station. A plurality of individual connectors are generally located in tandem orientation in a magazine which can be loaded into the hand applicator. The connectors are then in alignment with the connector terminating station. At least one ridge is provided in both the connector terminating station of the tool and in the magazine. Registry is maintained between the ridge and an appropriate slot or groove on the outer surface of one connector housing component. This ridge both aligns the individual connectors and provides a reaction surface as a torque is applied to the connector. A hand tool which can be efficiently used in a field environment is provided by the preferred embodiment of this invention.

DESCRIPTION OF THE DRAWINGS

FIG. 3 is a transverse section showing the various components of the connector in the unterminated position.

FIG. 8 is a section through the terminating section of a suitable hand tool showing connectors in their unterminated positions.

DETAILED DESCRIPTION OF THE INVENTION

A rotary electrical connector is disclosed and claimed herein. The preferred embodiment is intended for use in splicing a plurality of insulated wires. The principle of this invention is not limited to splicing alone. A similar rotary device could be used to attach wires to terminal elements. In any such embodiment, however, the connector is especially adapted for use as a moisture-proof connector.

Figure 1:
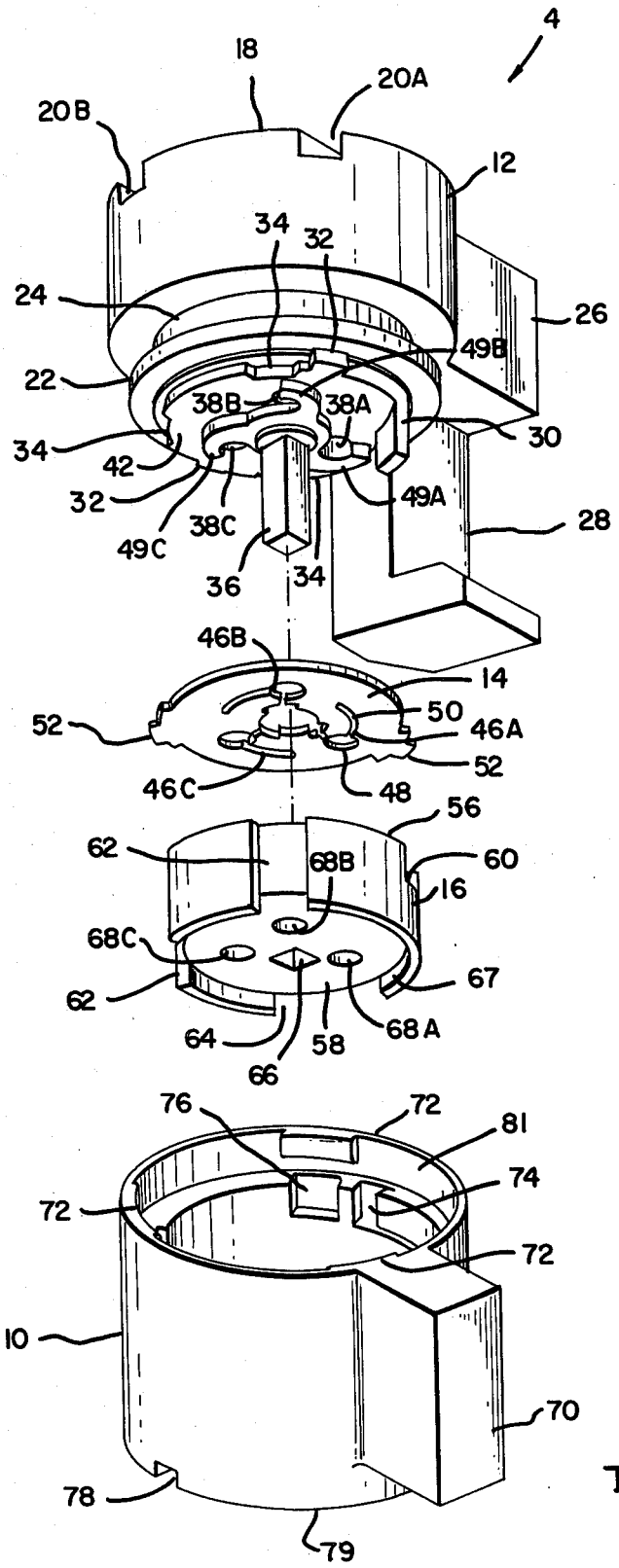
FIG. 1 is a perspective view showing the various components of the connector.

FIG. 1 is an exploded perspective view showing the various components of a rotary waterproof splice connector constructed in accordance with principles of this invention. The connector shown includes an outer casing 10 which receives a generally cylindrical plug member 12. A generally circular plate-like contact terminal 14 can be mounted on first insulating or plug member 12 between plug member 12 and second insulating or base 16, both located within a third insulating or casing member 10.

The configuration represented by the preferred embodiment of this invention is especially significant in view of the integrity of the electrical connection in a moisture-proof or moisture-tight environment. This integrity is due in part to the internal cavities which contain the viscous moisture-proof sealant. The sealant can be initially injected into the connector through tubular passages 38. Since the bottom cavity communicates with all tubular passages 38 the sealant can flow among the three cavities shown. The sealant can also flow upward through longitudinal cavities 62 and 64 to completely encapsulate the contact terminal, the contact interface, and to seal the outer portions of the plug member adjacent to annular ring 22.

Figures 1A, 2:
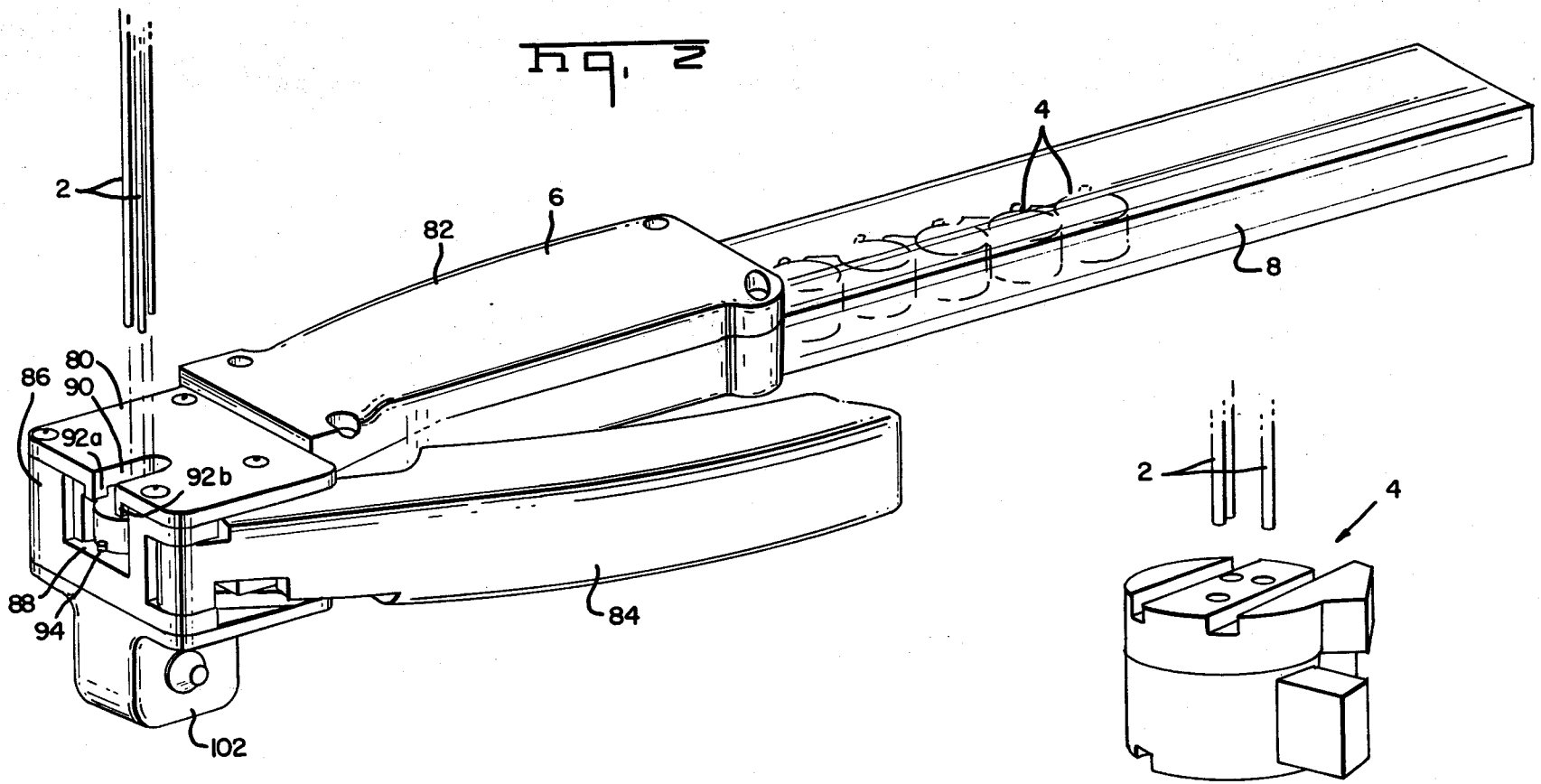
FIG. 1A is a perspective view of the assembled connector in its unterminated state.
FIG. 2 is a perspective view showing a hand tool with connectors loaded in a magazine.

FIG. 2 shows a simple hand tool which can be used to splice a plurality of conductors 2 in a given connector 4. Connectors 4 can be loaded into a magazine 8 which is in turn inserted into hand tool 6 to feed successive connectors located in tandem.

Plug member 12, best shown in FIG. 1, is generally cylindrical and is formed of a suitable insulating material such as a polyvinyl chloride. The right-circular cylindrical plug member 12 has a prismatic arm member 26 extending radially at one position on the circumferential edge. Arm 26 is generally integrally molded with plug member 12. Arm 26 has a generally rectangular recess 28 extending inwardly from one axial side. The outer or top face 18 of plug 12 has two generally parallel transverse grooves 20A and 20B, each having a generally rectangular cross-section, extending across its surface. Grooves 20A and 20B are also depicted in FIG. 1A. An annular groove 24 located intermediate the ends of plug member 12 is flanked by an annular ridge 22 and by the portion of plug member 12 adjacent to top face 18. Note that annular groove 24 is adjacent one face of rectangular indentation 28 in arm 26. An interior face 42, located on the opposite surface from top face 18, extends adjacent to and spaced from an annular ring 22. Three axially extending parallel tubular passages, (see FIG. 1A) extend through plug member 12 from top face 18 to interior face 42. These three passages 38A, B and C are each equally spaced from and parallel to the central axis of rotation for plug member 12. Upstanding post 36 is located in the center of plug member 12. Note that post 36 has a generally square cross-section. A single axially extending plug key pin 30 extends outwardly from interior face 42. This pin is located along the periphery of face 42 and is generally arcuate in cross-section. A plurality of indentations and bosses extend along the circumferential edge of the plug member adjacent to the interior face 42. Two radially extending bosses 32 are located along this circumferential edge. Three arcuate indentations 34 are also located on this circular edge. The one peripheral indentation partially obscured by post 36 in FIG. 1 is somewhat larger than the other indentations shown. Radial stuffer arms 49A, B and C extend from face 42 and are located along one wall of corresponding tubular cavities 38A, B and C.

Metallic plate-like member 14 comprises a stamped member of a material having spring-like properties. This circular terminal member has three arcuate slots 46A, B and C equally spaced from the central axis of rotation. Slots 46 are formed by concentric edges 50 over a major portion of their respective length. The width of each slot is essentially constant. However, an enlarged wire entry portion 48 is located adjacent one end of each slot. In the embodiment shown, each wire entry portion 48 comprises a circular stamped portion. As shown in FIG. 1 the wire entry portions 48 are located at the leading edge of each slot, assuming the slots are rotated in a clockwise direction. A central hole is located immediately surrounding the central axis of rotation of terminal plate 14. Two radially extending tabs 52 are located at separate positions on the circumference of terminal 14.

A cylindrical base member 16 also formed of an insulating material such as polyvinyl chloride is located adjacent terminal plate 14. Terminal 14 is located between interior face 42 of plug 12 and interior face 56 of base 16. Face 56 is quite similar to face 42. The bottom face 58 of plug 16 is generally parallel to face 56. Three equally spaced tubular passages 68A, B and C extend from face 56 to face 58 in base 16. Axially extending tubular passages 68 are mutually parallel and equally spaced from the central axis of rotation of the connecting device. A centrally located opening 66 having a generally square cross-section also extends through plug 16 between face 56 and face 58. By inserting post 36 on plug member 12 into this square opening 66 the three axially tubular passages 68 can be precisely aligned with axial tubular passages 38A, B and C in plug member 12. A flange 67 is located on the peripheral edge of base 16. Flange 67 is interrupted by three axially extending indentations, each of which extends from face 56 past face 68. Notice that flange 67 also extends beyond face 58. One indentation, 64, is larger than the remaining two indentations 62. A fourth indentation 60 extends from face 56 to a point intermediate faces 56 and 58. It should be apparent from FIG. 1 that peripheral indentation 60 will mate with plug key member 30 when plug 12 and base 16 are mated.

The fourth component of connector 4 is an outer casing member 10. Casing 10 is similarly molded from an insulating plastic such as polyvinyl chloride. Casing 10 has a right-circular cylindrical cross-section. Circumferential wall 81 extends upwardly from circular casing bottom wall 79, to form a central cavity for receiving the plug member 12, terminal 14 and base 16. Three inwardly extending bosses 72 are located along the free end of circumferential wall 81. Spaced inwardly from bosses 72 a plurality of peripheral indentations located on the inner surface of casing member 10. Rectangular indentation 76 is apparent in FIG. 1. Indentation 74 immediately adjacent indentation 76 communicates with a second similar indentation, the view of which is obstructed in FIG. 1. A radially extending arm 70 is located on the outer surface of casing 10. Arm 70 is generally rectangular in cross-section, and is the same size as indentation 28 in plug arm 26. A laterally extending groove 78 is located on the exterior of bottom wall 79.

Figure 4:
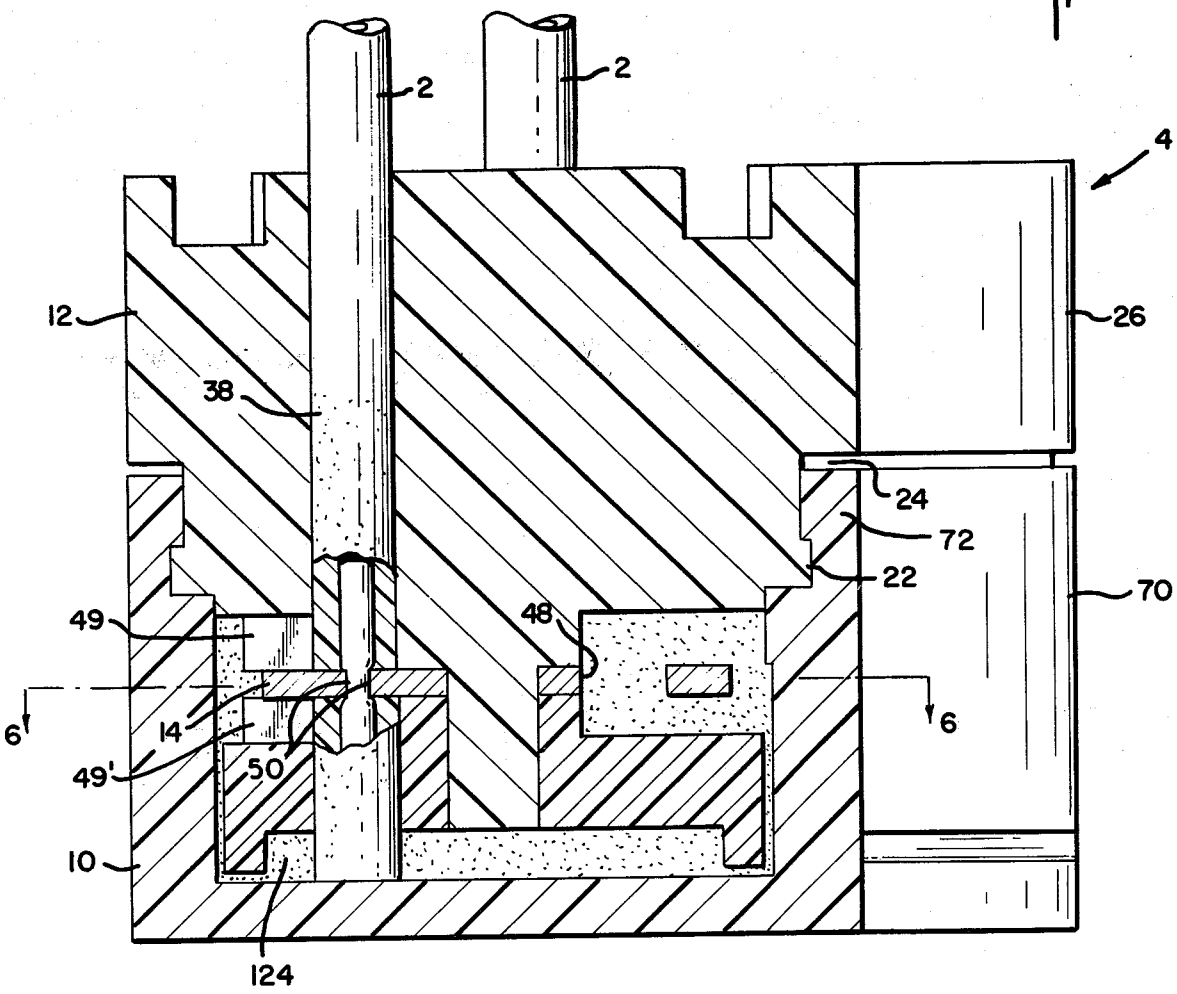
FIG. 4 is a section view similar to FIG. 3 showing a connector after termination.

Both FIGS. 3 and 4 are transverse sections taken through connector 4. FIG. 3 shows an unterminated connector with conductors 2 in position for insertion into appropriate tubular passages 38. Each section view is taken through one tubular passage 38. Note that a viscous sealant 122 is stored in channel 38. Sealant 122 is located in at least a portion of tubular passage 38 between terminal 14 and the top face 18 of the connector, and between terminal 14 and annular ring 22. This viscous sealant can be composed of a moisture-proof material having a polybutene base. Sealant 122 would be initially stored in each of the three tubular passages 38A, B and C. In the internal passage 38 shown in FIG. 3 note that terminal entry portion 48 is in alignment with tubular passage 38 so that a conductor 2 may be inserted completely into and beyond terminal 14. FIG 3 also shows an additional internal cavity 124 located between face 58 of base 16 and the bottom wall 79 of outer casing 10. This internal cavity 124 communicates with all three tubular passages 38. FIG. 3 also illustrates the manner in which plug member 12 is retained within outer casing 10. Note that the bosses 72 located on the outer rim of casing 10 can be snapped into the annular groove 24 on plug member 12. Bosses 72 are shown on either side of FIG. 3. Annular ring 22 on plug member 12 also snaps in place beneath bosses 72 on casing 10. Plug member 12 is thus retained within casing 10 and resists axial forces but remains free to rotate with respect to casing 10.

FIG. 4, taken along the same plane as the section in FIG. 3, shows a terminated connector. Note that terminal 14 has been rotated with casing 10. Rotation of terminal 14 causes slot edges 50 to penetrate the insulation of a wire 2 and establish electrical contact with the underlying conductive core of wire 2.

Figure 7:
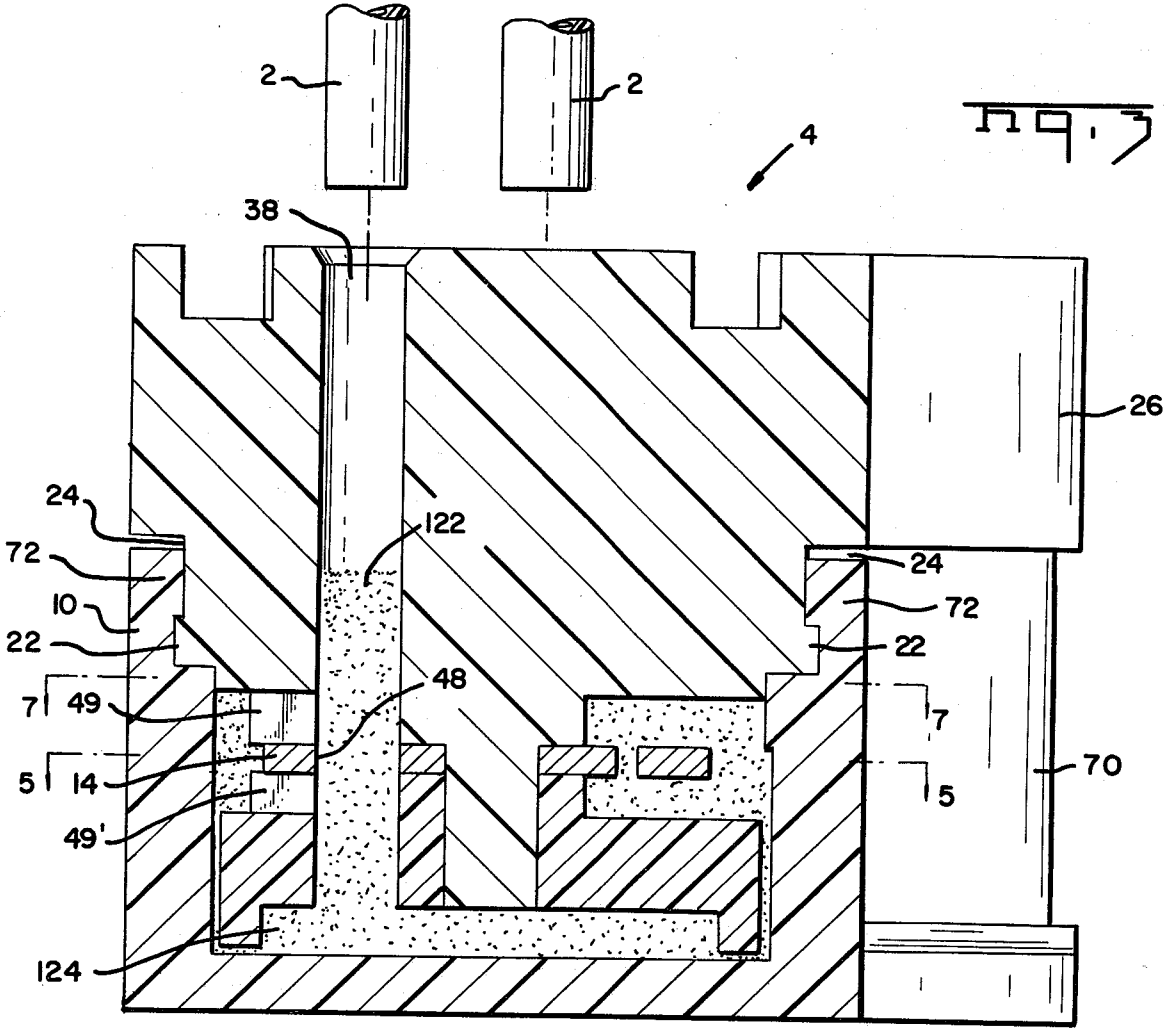
FIG. 7 is a horizontal section view showing the mating of the inner and outer housing members.
Figure 5:
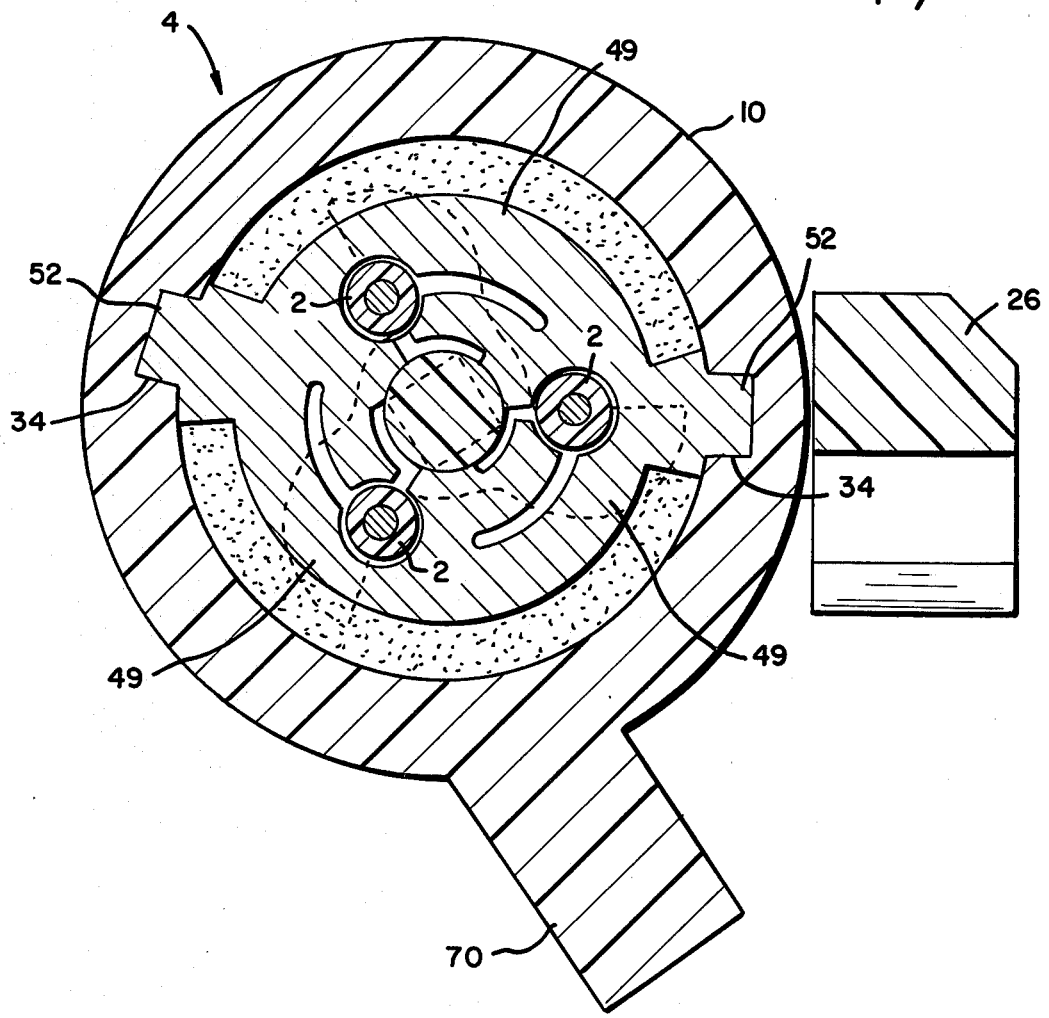
FIG. 5 is a horizontal section view through the terminal with the connector in unterminated position.
Figure 6:
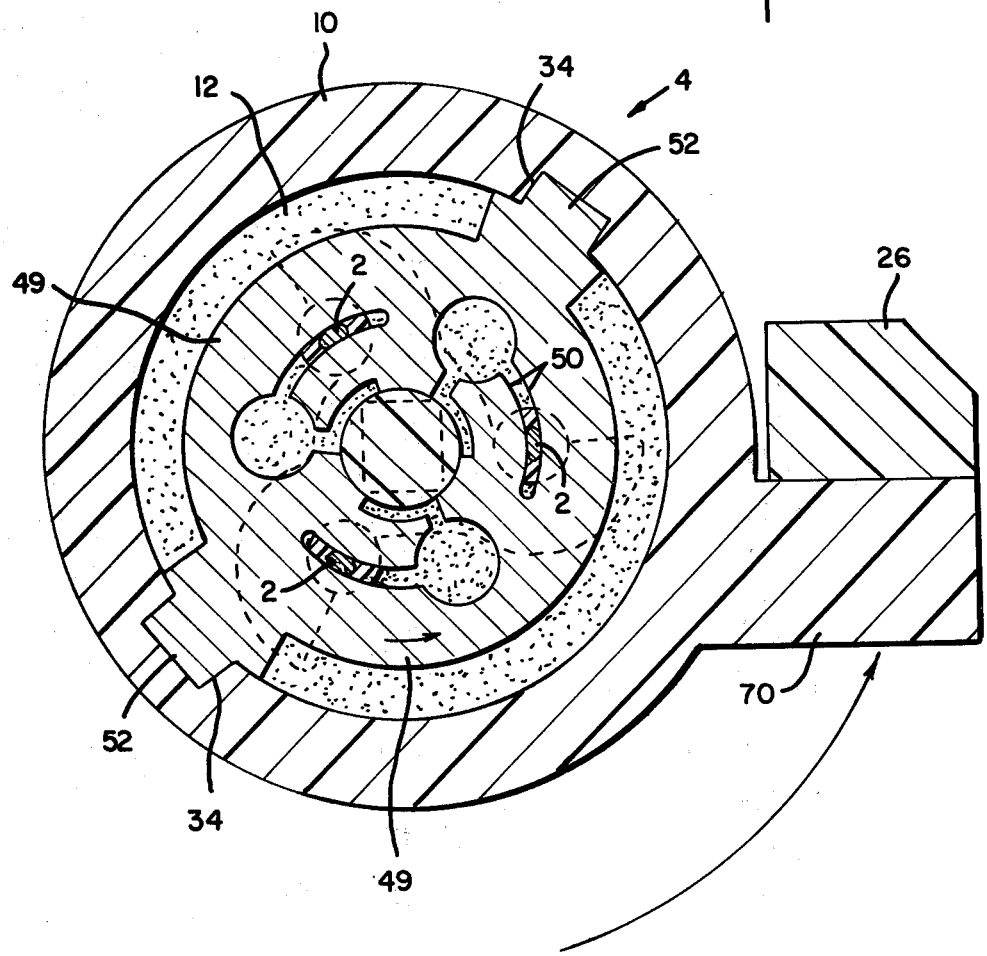
FIG. 6 is a section view similar to FIG. 5 showing the terminated position.
Figure 7:
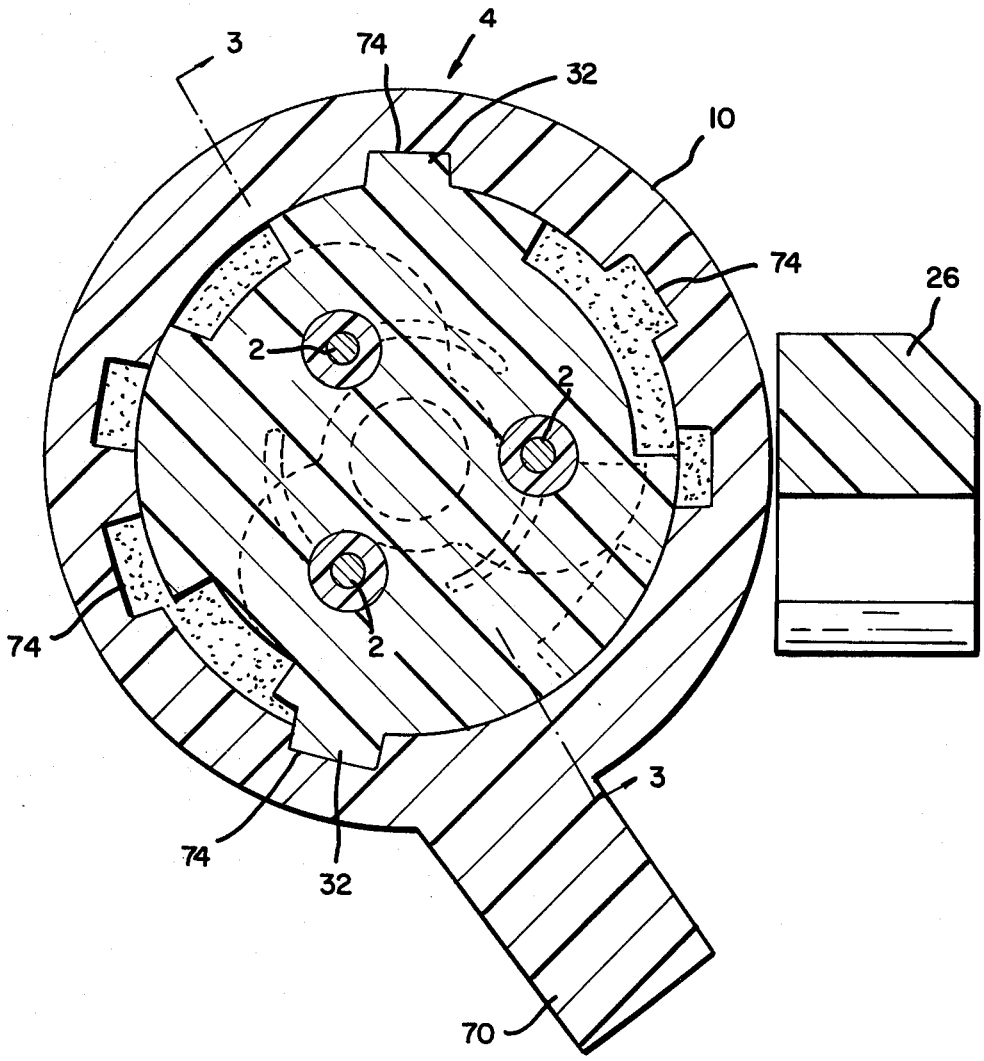
Figure 6:
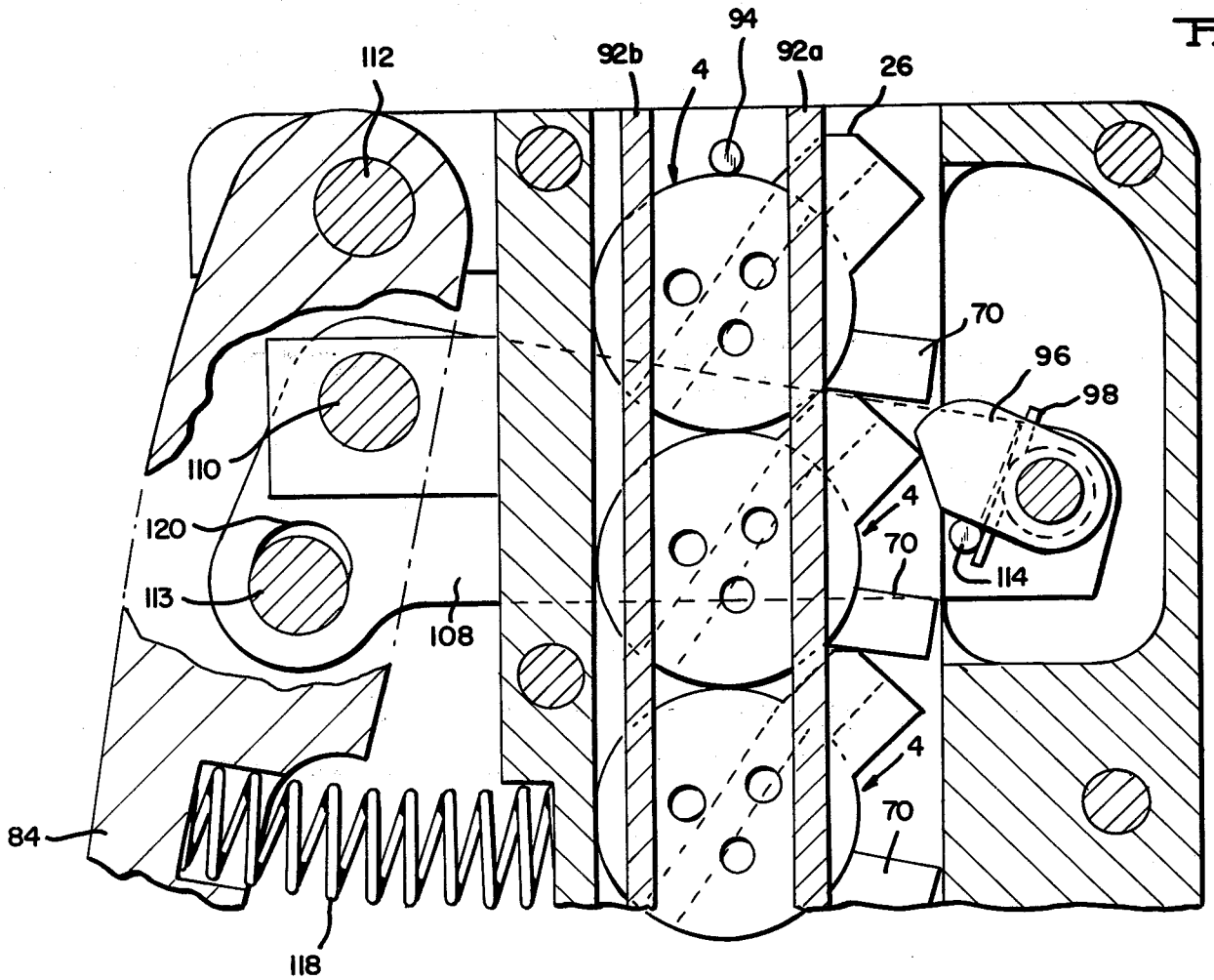

FIGS. 5, 6 and 7 are horizontal sections taken along the section lines indicated in FIGS. 3 and 4. Sections 5 and 6 are each taken through the terminal 14. FIG. 5 shows the unterminated state. FIG. 6 shows the terminated state. Note that the two terminal key tabs 52 located on the circumferential edge of terminal 14 are received within corresponding peripheral indentations 34 in casing 10. As casing 10 is rotated with respect to plug member 12 these tabs lock terminal 14 with respect to casing 10. Terminal 14 then rotates with casing 10. In FIG. 5 is should be clear that conductors 2 have been inserted into internal passages 38A, B and C. Each conductor extends through the enlarged wire entry portion 48 of the corresponding slots 46A, B and C. Radial stuffer arms 49 are shown as dotted lines in FIG. 5. It should be apparent that the viscous sealant extends around the contact interface.

FIG. 6, which illustrates the terminated state of connector 4, shows that the outer casing 10 and the terminal plate 14 have been rotated bringing the slot edges 50 into contact with the conductive core of each wire 2.

FIG. 7 which is taken along a plane parallel to section 5, shows connector 4 again in its unterminated state. Section 7 shows the interengaging relationship of the radially extending boss members 32 on plug member 12 and the corresponding indentations 74 located on casing 10. It should be noted that each boss 32 corresponds to a pair of indentations 74 on casing 10. With the connector in its open position shown in FIG. 7, the boss 32 is located in an appropriate indentation 74. The inner wall of casing 10 between each pair of indentations 74 is slightly recessed. As the outer casing 10 is moved in a counterclockwise position as seen in FIG. 7, each boss 74 will be forced out of the indentations as shown in FIG. 7 with the boss 32 being rotated into the other indentation 74. The connector 4 can thus be retained in only two positions, the unterminated position of FIGS. 5 and 7 and the completely terminated position which is shown in FIG. 6.

Connectors 4 can be terminated using a simple pair of pliers to rotate casing 10 relative to plug 12. Pliers can be used to engage radial arms 26 and 70. It will often be necessary, however, to use a more elaborate hand tool to efficiently terminate connectors 4 for splicing of two or three conductors in a field environment. Hand tool 6 shown in FIG. 2 is a tool satisfying this need. A plurality of connectors 4 can be loaded into a disposable magazine 8 which in turn can be loaded into hand tool 6. Successive connectors 4 can then be fed into a connector terminating station in terminating head 80 located at one end of the hand tool. FIG. 2 illustrates that a magazine 8 can be loaded into one handle of tool 6 and connectors will then be positioned in line with the terminating head. Magazine 8 has two longitudinal ribs 116A and B extending inwardly from one of the four sides of the hollow magazine 8. Ribs 116A and B are offset with respect to the center-line of magazine 8. This allows room for radially extending arms 26 and 70 of connector 4. Note in FIG. 10 that the two laterally extending grooves 20A and 20B located in the top face of connector 4 will receive ribs 116A and B when connectors 4 are loaded in a tandem relationship in magazine 8. An appropriate spring member 104 extending from the tool head region can be clipped on the rear connector thus feeding each connector successively into the terminating region. Spring 104 can be received in well member 102 located below the tool head 80. Spring 104, which resembles a clock spring, is chosen so that an essentially constant force is exerted on the row of connectors irrespective of length. Two rails 92A and 92B located on the upper surface of tool head 80 and extending into open connector feed cavity 88 serve as extensions of magazine rails 116A and 116B. These two rails or ribs 92A and 92B position the connector 4 in proper alignment. Connector feed cavity 88 comprises an open ended cavity defining a connector terminating station in tool head 80.

Figure 9:
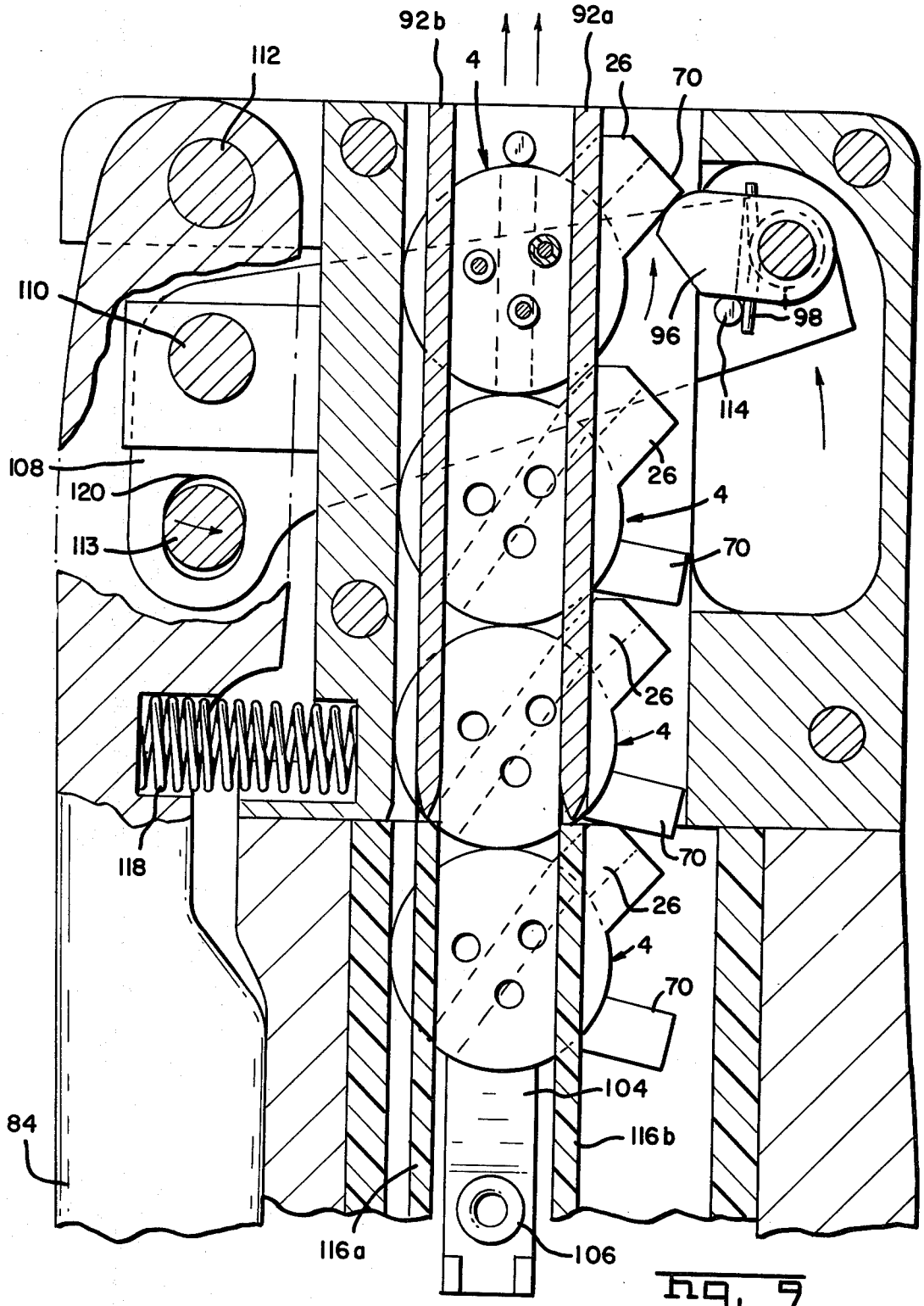
FIG. 9 is a section view similar to FIG. 8 showing the termination of a single connector.

In conjunction with accompanying lever actuating members a pawl member 96 located on one lateral side of open ended connector feed track 88, is used to impart the torque necessary to close each connector thus comprising connector terminating means. FIG. 8 is a section view showing the foremost connector 4 in the unterminated position. Note that pawl 96 is located adjacent to laterally extending casing arm 70. Wires 2 can be inserted into terminal passages 38 through a U-shaped opening 90 located in the upper surface of tool head 80. Once the wires are in proper position the operator can now depress handle 84. Handle 84 pivots about point 112 driving toggle link 108 which is in turn pivoted about point 110. Handle 84 which is spring-loaded, drives toggle link 108 through pivot pin 113 located in slightly elongated slot 120. As handle 84 is depressed toggle link 108 is driven counterclockwise from the position of FIG. 8 to the position of FIG. 9. Pawl 96 which rests against stationary post 114 imparts a counterclockwise torque to casing arm 70. Counterclockwise rotation of casing 10 with respect to plug 12 results in counterclockwise rotation of terminal 14 with respect to each conductor 2 located in each internal passage 38. Since rails 92A and B extend through transverse channels 20A and 20B located in the top surface of plug member 12, plug member 12 is prevented from rotating under the counterclockwise torque imparted by pawl 96.

Figure 10:
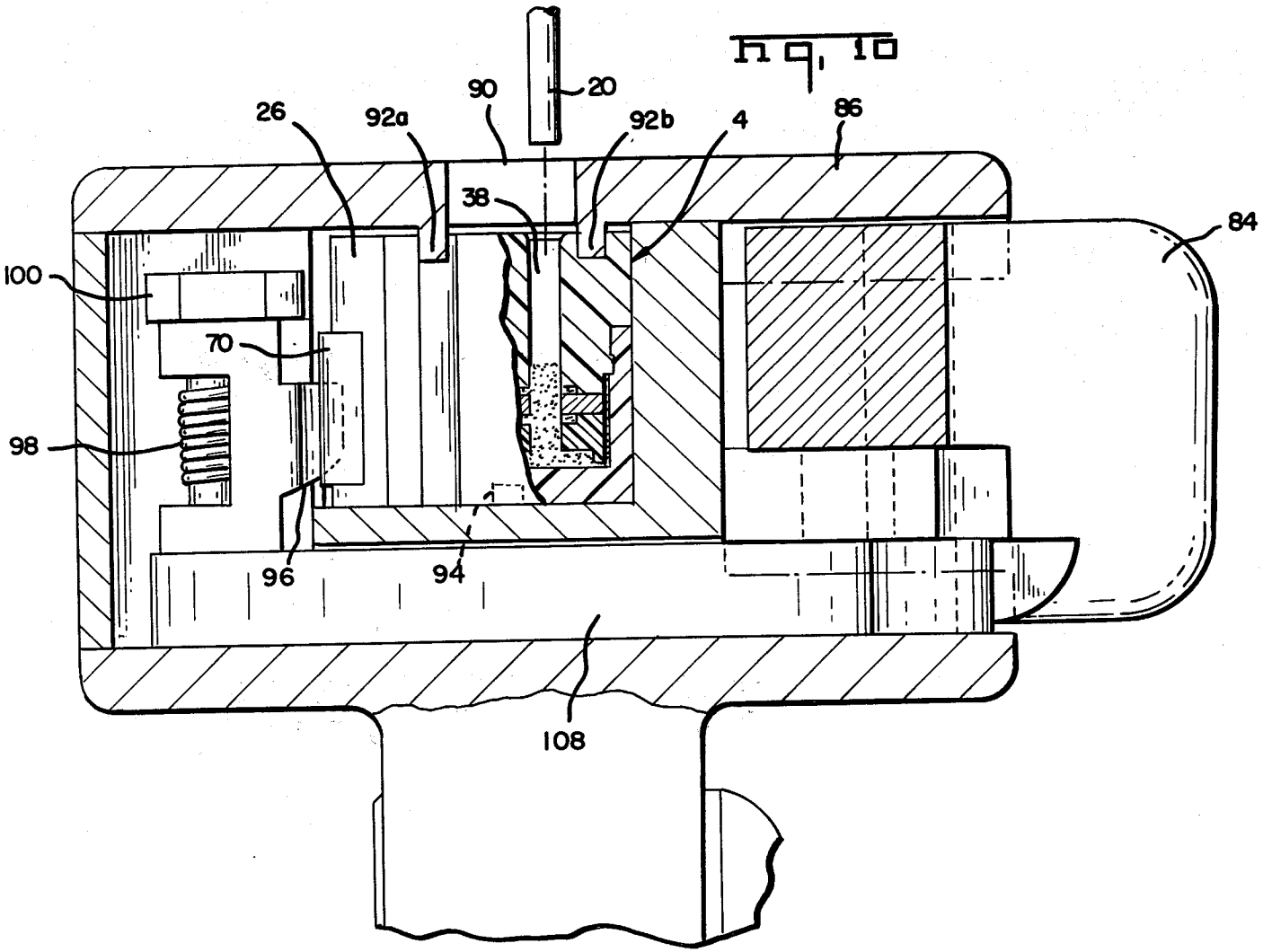
FIG. 10 is a section view in a plane perpendicular to the sections shown in FIGS. 8 and 9 showing the mechanism of the hand tool.

Each foremost connector is held in position for termination by a small centrally located pin or stop member 94 extending into open ended track 88 at the upward edge of hand tool 6. As the outer casing is rotated, the single transversely extending groove 78, located on the exterior of the bottom wall of casing 10, is likewise rotated. Groove 78 which is shown as a pair of dotted lines in FIGS. 8 and 9 moves into a position parallel to grooves 20A and 20B. At this point, connector 4 is free to move past pin 94 and out of the front edge of tool 6. The next connector can then move into position for termination. Note that pawl 96 is spring loaded and can pivot in the clockwise direction to allow each successive connector 4 and its associated pivot arms 56 and 70 to move therepast. A transverse section of a tool head with a single connector 4 located in unterminated orientation in tool 6 is shown in FIG. 10.

We claim:

1. Apparatus for splicing a plurality of wires in a two-part rotary actuated electrical connector, said apparatus comprising:

(a) a connector termination station comprising means for sequentially receiving a plurality of connectors in tandem configuration, said connector terminating station being open on first and second opposite ends, (b) connector feeding means for advancing said connectors sequentially into said connector terminating station from said first end, (c) connector stop means for abutting the first part of a connector and positioning the connector in the connector terminating station, said connector stop means being adjacent to said second end, (d) alignment means in the connector terminating station for guiding connectors through the connector station terminating station and for preventing rotation of the second part of a connector in the connector terminating station, said alignment means extending from said first to said second end of the connector terminating station, and (e) connector terminating means for imparting a force to the first part of a connector in the connector terminating station to cause relative rotation between the first and second parts of a connector, whereby wires are positioned in a connector located in the connector terminating station and electrically interconnected upon relative rotation between the first and second connector parts.

2. A tool for sequentially actuating a series of electrical connectors deployed in tandem configuration, each connector for splicing a plurality of wires upon relative rotation, about a connector axis of rotation, between first and second connector parts; and said tool comprising:

(a) a connector terminating head having a cavity extending therethrough from a first open end to a second open end, said cavity being defined by four interior walls and having a generally rectangular cross-section for receiving said connectors with the connector axis of rotation extending perpendicular to the axis of said cavity, (b) at least one rib extending along an upper wall of said cavity from said first end to the vicinity of said second end, for engaging a corresponding longitudinal channel on the second part of a connector in the cavity, to prevent rotation of the second part in the cavity, (c) connector stop means for abutting a connector in said cavity adjacent the second end of said cavity, (d) connector feeding means for advancing said connectors sequentially through said cavity from the first to the second end, (e) connector terminating means for imparting a force having a line of action, directed from said first to said second end, to the first part of a connector in said cavity to cause relative rotation between the first and second parts of a connector, whereby a plurality of wires are positioned in a connector located in said cavity and electrically interconnected upon relative rotation between the first and second connector parts.

3. A tool as set forth in claim 2 wherein said connector terminating means comprises a pawl member and lever means, said pawl member being movable along a side wall in said cavity to impart a force to a radially extending arm on said connector.

4. A tool as set forth in claim 3 wherein said connector stop means comprises a stationary upstanding member on the bottom wall of said cavity located adjacent the second end of said cavity, said stationary upstanding member abutting the first part of a connector in said cavity until said first part is rotated to permit said upstanding member to move through a groove in said first part.

5. A tool as set forth in claim 4 wherein said connector feeding means comprises spring means.

6. A tool as set forth in claim 5 wherein said spring means comprises a spring which exerts a force generally independent of linear deflection.

7. A tool as set forth in claim 6 wherein said lever means is pivoted about a point on the side of said cavity opposite from said pawl member.

8. The combination of a tool and a connector magazine for sequentially feeding a series of electrical connectors from said magazine to said tool and for sequentially actuating each connector in said tool, said connectors for splicing a plurality of wires upon relaive rotation, about a connector axis of rotation, between first and second connector parts; said combination comprising:

(a) a magazine for holding a plurality of connectors in tandem configuration, said magazine further comprising:

(i) four longitudinal walls defining a longitudinal cavity adapted to retain said connectors therein, (ii) at least one longitudinal ridge, extending along the inner surface of a first of said magazine walls, adapted to be received in a corresponding channel on said second connector part, (iii) a longitudinal slot extending in a second of said magazine walls, (iv) an open end to permit said connectors to sequentially pass from said magazine, (b) a tool for sequentially splicing a plurality of wires in each of said connectors, said tool further comprising:

(i) a connector terminating station, (ii) rib means for aligning connectors in said connector terminating station and preventing rotation of the first part of each connector, (iii) magazine holding means for positioning said open end of said magazine adjacent the first end of said connector terminating station with said ridge in alignment with said rib means, (iv) connector feeding means for engaging connectors in said magazine through the magazine longitudinal slot and sequentially advancing said connectors from said magazine into said connector terminating station, (v) connector stop means for positioning the foremost connector adjacent the second end of said second terminating station, and (vi) connector terminating means for causing relative rotation between said first and second connector parts;

whereby successive groups of wires are sequentially spliced in said connectors.

* * * * *